United States Patent [19]

Scholz et al.

[11] 3,954,377

[45] May 4, 1976

[54] VERTICAL MOLD FOR MAKING TEXTURED CONCRETE PANELS

[75] Inventors: Ray John Scholz; Thomas Patrick Fuller, both of Los Altos, Calif.

[73] Assignee: Torres, Inc., Mountain View, Calif.

[22] Filed: Sept. 12, 1974

[21] Appl. No.: 505,417

Related U.S. Application Data

[62] Division of Ser. No. 279,406, Aug. 10, 1972, Pat. No. 3,843,089.

[52] U.S. Cl. ..... 425/432; 249/16; 249/112; 249/161; 249/168

[51] Int. Cl.[2] ..... B28B 1/08; B28B 7/06

[58] Field of Search ..... 425/441, 432; 249/112, 249/119, 120, 129, 131, 161, 15, 16, 18

[56] References Cited

UNITED STATES PATENTS

| | | | |
|---|---|---|---|
| 3,471,910 | 10/1969 | Slavin | 249/120 |
| 3,759,481 | 9/1973 | Scott | 249/112 |
| 3,785,608 | 1/1974 | Heinzman et al. | 249/163 |
| 3,804,361 | 4/1974 | Camus | 249/120 |

*Primary Examiner*—Francis S. Husar
*Assistant Examiner*—John McQuane
*Attorney, Agent, or Firm*—Townsend and Townsend

[57] ABSTRACT

A textured mold for vertically casting concrete wall slabs. The mold has one mobile vertical form wall mounted on a supporting carriage which runs along a track and a stationary vertical form wall rigidly anchored to a concrete foundation. Each form wall has a textured mold liner permitting various patterns to be impressed upon the surface of the concrete slabs. The carriage of the mobile form permits the mobile form to be removably connected to the stationary form. This concrete mold permits vertically casting concrete wall slabs with textured surfaces formed into the wet concrete.

5 Claims, 6 Drawing Figures

VERTICAL MOLD FOR MAKING TEXTURED CONCRETE PANELS

This is a division of application Ser. No. 279,406, filed Aug. 10, 1972, now U.S. Pat. No. 3,843,089.

BACKGROUND OF THE INVENTION

This invention relates to prefabricated concrete building construction and, more particularly, to the molds for producing precast concrete wall slabs.

SUMMARY OF THE INVENTION

Precast concrete wall slabs have been used in the building construction industry for many years. Usually, the concrete slabs are poured using production line techniques at a remote factory site and then transported to the various construction sites where the slabs are installed as floors and walls. Generally, the concrete slabs are poured horizontally using the ground to support one side of the form. Heretofore, horizontal casting has been preferred because the ground easily supports the heavy weight of the concrete and an extensive mold supporting structure is not required.

One of the many advantages of precasting concrete walls is the ability to place a texture onto the surface of the wall during its casting. The texture can be either a stylized pattern or a natural finish. In the past, texture was impressed into one side of the wall by placing in the bottom of the form a mold liner having the desired texture. As the concrete hardened, the texture of the mold liner was impressed on the bottom side of the slab.

If a texture was desired on the top side of the slab in addition to a texture on the bottom side, four methods were commonly used. The first method stamped the texture into the wet concrete with an open, grate-like, skeletal frame. The skeletal frame had projecting ribs that forced the impression into the surface of the wet concrete. Stamping down with an unperforated mold on the top side of the slab is unsuccessful because pockets of air are entrapped between the surface of the wet concrete and the surface of the mold. In the second method the top surface is smoothly finished and then after drying, etched with acid. The extent and depth of the texture is achieved by masking the surface and controlling the amount of acid contact. Another technique involves sandblasting the texture into the slab after drying. The fourth method requires plastering the concrete wall after the slab is erected and forming the desired texture in the wet plaster.

The mold construction and vertical pouring method permits concrete wall slabs to be poured so that both surfaces of the wet concrete slab can be impressed with a desired texture. No sandblasting, acid etching, or further finishing is required. The textures are simultaneously cast into the panels. In addition, numerous different texture patterns are possible and each pattern is easily incorporated into the mold. The mold can cast slabs with the identical texture on both surfaces or with a different texture on each side.

The present invention is directed to a mold that can be readily assembled and disassembled for use and reuse in the formation of concrete slabs. The mold includes first and second concrete impervious form members adapted to be disposed in confronting, releasable coupling relationship on a base member. One of the form members is fixedly positioned with respect to the base member while the second form member is generally movable therefrom to enable the width of the concrete slab to be varied and ultimately for the concrete slab to be removed from the mold. The mold further includes a pair of side members for closing relationship with the side openings defined by the first and second members.

The concrete mold of this invention includes a mobile, vertical form wall having a removable mold liner attached to its face. The mobile form wall is erected on a carriage which rolls on at least two rails of a track and which moves along the ground generally perpendicularly to the face of the mold liner. The mold also has a stationary, vertical form wall rigidly mounted on a concrete foundation. On the face of the stationary form wall is another removable mold liner in opposing relationship to the mold liner on the mobile form wall. Since the slab is vertically poured, the trememdous weight of the concrete pushing the forms apart must be restrained. The curbing of the concrete foundation of the stationary form permits the carriage of the mobile form to pass beneath the stationary form and to engage the rear supporting structure of the stationary form thereby locking the forms together. The mobile form and the stationary form are also held together by turnbuckles located around the periphery of the two forms. Two vertical end gates perpendicularly anchored to the forms are the end of the mold and prevent the concrete from slipping out between the ends of the mold liners. The foundation curbing provides the bottom for the mold.

DESCRIPTION OF THE PREFERRED EMBODIMENTS

Figure 2:
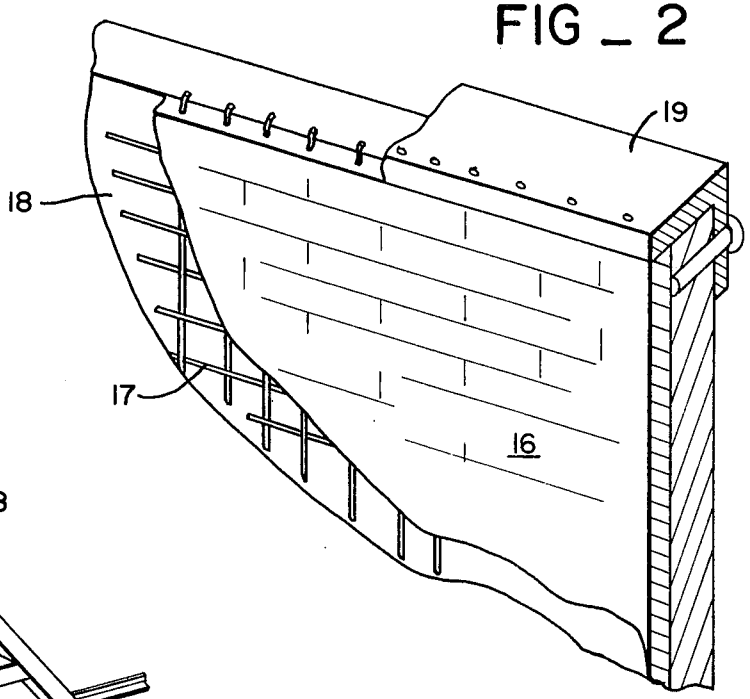
FIG. 2 is a perspective view partially in section and broken away of a mobile form wall.
Figure 1:
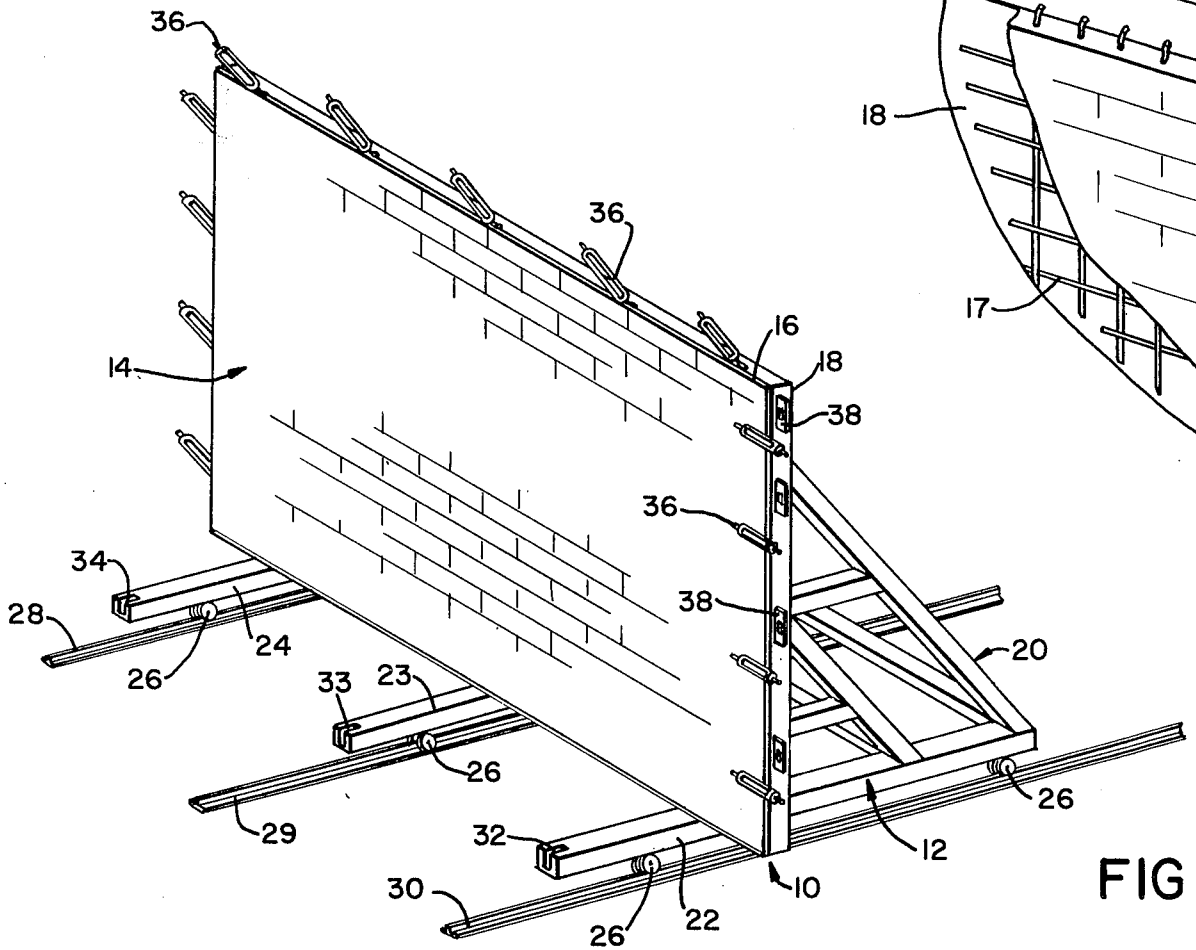
FIG. 1 is a perspective view of a mobile vertical form.
Figure 3:
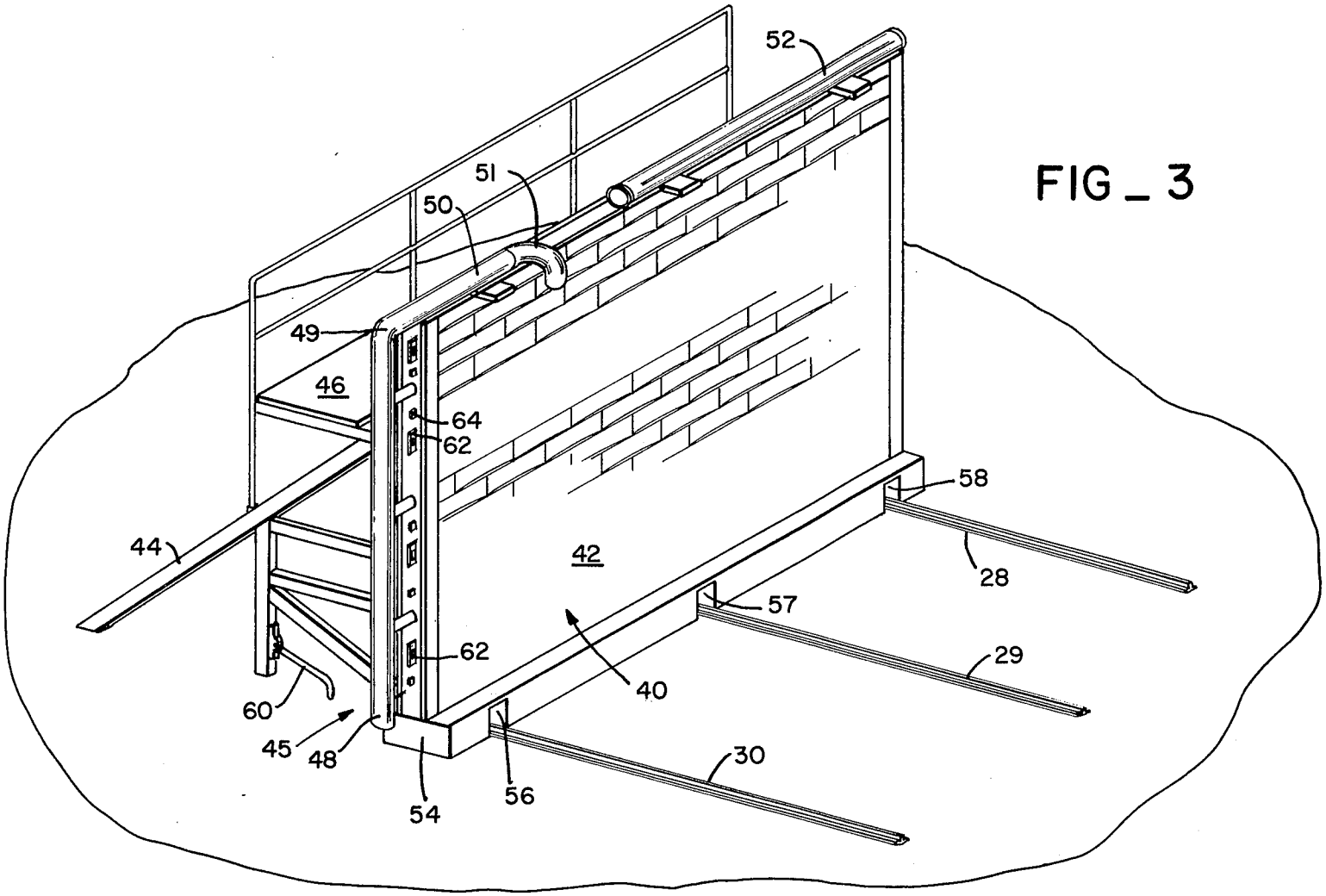
FIG. 3 is a perspective view of a stationary form showing the pipes for pouring concrete into the mold.
Figure 4:
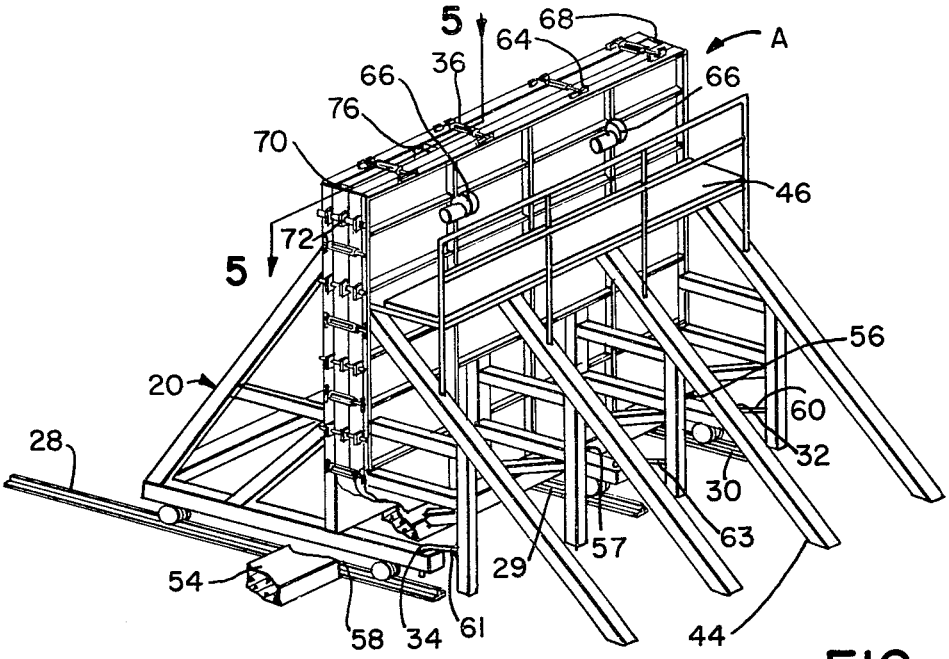
FIG. 4 is a perspective view partially broken away of the mobile form and the stationary form locked together. (The concrete pouring pipes have been omitted for clarity)

Turning to the drawings wherein similar characters of reference represent corresponding parts in each of the several views, mold A is formed of a generally mobile vertical form 10, primarily described in FIGS. 1 and 2 and stationary vertical form 40, primarily described in FIGS. 3 and 4.

Referring first to FIG. 1, mobile form 10 has carriage 12 and form wall 14. The form wall 14 is comprised of mold liner 16 and backing 18. Mold liner 16 is a thick rubber sheet that has a textured surface to be impressed against the wet concrete during casting. The textured surface on mold liner 16 is attached by casting the liner on a primary mold (not shown) in a conventional manner. The mold liner can be fabricated from rubber or any suitable moldable material such as fiberglass, polyvinyl chloride, or cold mold rubber. Rubber is preferred because it is sufficiently pliable so that the mold liner will release itself from around undercuts (indentations) in the textured concrete without breaking the webs of the newly cured concrete.

As can be seen most clearly from FIG. 2, mold liner 16 is formed with steel fabric wire 17 embedded in the rubber. The ends of fabric wire 17 that protrude from the extremities of mold liner 16 are welded to peripheral angle iron frame 19. For clarity, fabric wire 17 and angle iron frame 19 are only shown in FIG. 2. It is intended, however, that FIG. 2 represent the construction of all form walls. Backing 18 is a sheet of exterior plywood cut to the dimensions of the mold liner. Mold liner 16 is permanently attached to backing 18 such as by gluing with conventional contact cement and bolting peripheral angle iron frame 19 to the backing. Thus, mobile form 10 has a rubber stamp-like face backed by a non-compressible wooden sheet.

Carriage 12 of mobile form 10 is formed of skeletal framework 20 and horizontal rails 22, 23 and 24. The framework is fabricated from standard steel stock and is of conventional design. Framework 20 supports form wall 14 on carriage 12 forcing form wall 14 against the weight of the concrete while the mold is in use. Rails 22, 23 and 24 are also fabricated from standard steel stock and are a structural part of framework 20. Wheels 26 are disposed below rails 22, 23 and 24 to support mobile form 10. The wheels are positioned to engage three parallel tracks 28, 29 and 30. Preferably, the tracks lie perpendicular to the face of form wall 14 to enable the carriage to travel back and forth in front of the stationary mold as hereinafter described.

Randomly spaced around the top and sides of the form wall 14 are a plurality of turnbuckles 36. Turnbuckles 36 are secured to mobile form 10, for example, by steel eyes welded on to framework 20. The eyes permit turnbuckles 36 to rotate sufficiently enough to engage corresponding hooks 64 on stationary form 40 as hereinafter described. The eyes, turnbuckles 36 and hooks 64 are used to releasably lock stationary form 40 and mobile form 10 together to form mold A, as shown in FIG. 4. A plurality of each is required to counteract the tremendous pressure exerted by the wet concrete that tends to force the two forms apart. Turnbuckles 36 are specifically used because they are adjustable for locking and unlocking purposes and adjustable for varying the spacing between the two forms.

Randomly spaced cleats 38 are welded to the two vertical sides of mobile form 10. The cleats are made of steel and guide the end gates or sides of the mold into place as hereinafter described.

In FIG. 3, reference numeral 40 generally indicates a stationary vertical form comprised of stationary form wall 42 and framework 44. Framework 44 is a steel skeletal structure similar in construction to framework 20. Framework 44 is securely embedded in a concrete foundation to hold form wall 42 in place against the weight of the concrete. Framework 44 is provided with platform 46 that runs along the top of stationary form wall 42 and provides access to the top of mold A for the workmen.

Concrete pouring pipe 45, mounted to framework 44, is formed of a vertical section 48 along one side of framework 44, elbow 49, horizontal section 50 and flexible section 51. During concrete pouring, the lower end of vertical section 48 is connected to a concrete pump (not shown) and flexible section 51 directed downwardly between the mobile form wall 14 and stationary form wall 42. When a production line having numerous vertical pouring molds is set up, and additional horizontal pipe 52 can be used. Thus, after concrete is poured into mold A, the flexible section 51 is attached to pipe 52 to enable the concrete to flow along the top of form wall 42 and into the next succeeding similarly placed mold (not shown).

Form wall 42 on stationary form 40 is also formed of a mold liner and a plywood backing. Referring again to FIG. 2, stationary form wall 42 is of similar construction and performs the same function as form wall 14 of mobile form 10. Both of form walls 14 and 42 are removably bolted to their respective frameworks so that mold liners can be easily interchanged. In this manner, an inventory of interchangeable form walls having different textured mold liners can be readily maintained. Suitable textures heretofore employed include slumpstone, brick, wood, and rope textures, as well as the texture on existing masonary walls. Removable form walls permit casting slabs to have identical texture on both sides or different textures on each side.

Stationary form 40 is located on top of a curb 54. Curb 54 is preferably of rectangular cross-section and extends for at least the length of form 40. The curb forms the lower boundary of mold A and is an integral part of the concrete foundation and framework that supports form wall 42. When mobile form 10 is secured to stationary form 40 as in FIG. 4, the top surface of curb 54 forms the bottom of mold A. Within curb 54 are three tunnels 56, 57 and 58 straddling respective of tracks 28, 29 and 30. The tunnels enable the forward ends of rails 22, 23 and 24 of mobile form 10 to extend through curb 54 beneath stationary form 40. Rails 22, 23 and 24 are provided with respective of slots 32, 33 and 34.

Reference numeral 60 indicates a latch made of steel that engages slot 32 on rail 22 to lock mobile form 10 against curb 54. Additional latches 61 and 63 are similarly disposed on framework 44 at the terminal ends of tracks 28 and 29, respectively. Latches 61 and 63 lock into slot 33 on rail 23 and slot 34 on rail 24, respectively. By advancing rails 22, 23 and 24 through tunnels 56, 57 and 58, latches 60, 61 and 62 can be engaged with slots 32, 33 and 34 to retain mobile form 10 adjacent stationary form 40. In FIGS. 3 and 4 the latches are shown for clarity as simple hooks pivotally mounted on framework 44. Alternatively, three turnbuckles, pivotally mounted to framework 44 can be utilized for releasably latching the rails to framework 44. When used, the turnbuckles permit the spacing between the form walls to be varied, thereby changing the width of mold A.

A plurality of randomly spaced cleats 62 is welded on the two vertical sides of stationary form 40. Cleats 62 are made of steel and are intended to cooperate with cleats 38 on mobile form 10. Cleats 38 and 62 are used to hold the sides or end gates of the mold in place as hereinafter described. Around the top and sides of form wall 42 is a series of hooks 64. Hooks 64 are preferably formed of steel that is welded to framework 44. The hooks are engaged by the terminal free ends of turnbuckles 36 on mobile form 10 when the forms are locked together.

In FIG. 4, reference numeral 66 indicates two external, electric vibrators. Vibrators 66 are rigidly attached to framework 44 and provide enough vibration to the mold to insure the complete compaction of the wet concrete within the mold. Vibrators 66 can be of conventional construction commonly used by the building industry in external vibration applications.

In operation, the wet concrete is held in place between forms 10 and 40 by two end gates 68 and 70 located at the sides of mold A. The end gates are rectangular, elongate steel plates that rest on top of the surface of curb 54 after mold A is assembled. The width of the end gates is larger than the unobstructed width between form walls 14 and 42. When the form walls are locked together with the end gates in place, rubber mold liners deform around the edges of end gates 68 and 70. The deformation of the rubber mold liners forms a fluid tight seal for the mold.

The outward facing side of each end gate is provided with a series of cleats 72 welded thereto in registry with cleats 38 on the mobile mold and cleats 62 on the stationary mold when the end gates are in position on the mold. The end gates are held in position when steel bars 74 are slipped between the three sets of cleats as shown most clearly in FIG. 5. The steel bars are nearly the same diameter as the openings in cleats 38 and 62 to provide for frictional capture by them.

Figure 6:
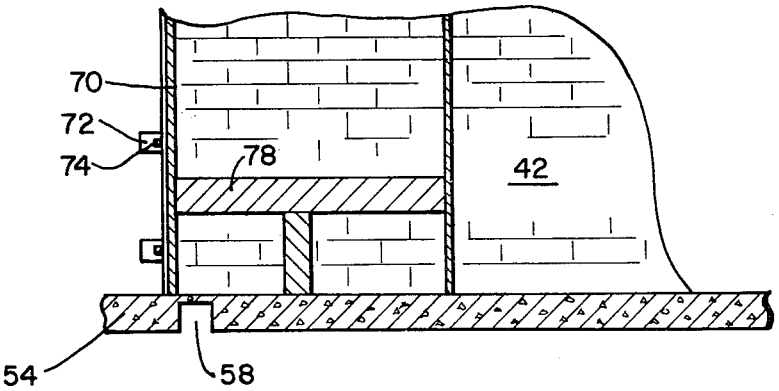
FIG. 6 is a side view partially broken away and in section of the stationary form taken along line 6—6 of FIG. 5.

When the length of the mold is desired to be decreased, slip gate 76 is used. Slip gate 76 is an elongate, rectangular steel plate having the same dimensions as an end gate and rests on the top surface of curb 54. The slip gate is mounted parallel to end gate 70 and also forms a water tight seal by the deformation of the mold liners about its edges. Cleats have not been found to be required on slip gate 76. Slip gate 76 is retained in place by support 78. Referring to FIG. 6, support 78 is preferably a wooden brace of suitable length disposed between end gate 70 and slip gate 76. The horizontal forces from the wet concrete pushing the slip gate outwardly are resisted by the support 78 acting against end gate 70 held in place by cleats 38, 62, 72 and bars 74.

To utilize the vertical mold of this invention, two mold liners 16 having the desired texture are fabricated. This is usually accomplished by constructing a mock up of the finished wall and then casting either cold mold rubber, fiberglass, or some other suitable compound on the model. It has been found that adobe brick, slumpstone, brick and rough hewn wood are suitable for texture patterns. Referring again to FIG. 2, a piece of fabric wire 17 is implanted in the middle of the mold liner 16 before the liner material hardens. The fabric wire is intended to reinforce mold liner 16 and provide a suitable anchoring foundation to secure mold liner 16 to backing 18. Backing 18 is advantageously fabricated from exterior plywood.

After the liner material has hardened, mold liner 16 is glued to backing 18 and the exposed ends of the fabric wire 17 welded to peripheral angle iron frame 19. The angle iron frame is in turn bolted to backing 18. The rubber mold liner is then glued to the plywood backing using conventional contact cement. The mold liners and backing used on both the mobile and stationary forms are constructed in exactly the same manner, from the same materials and are interchangeable in operation.

The casting process is commenced by first bolting two form walls 14 and 42 to steel framework 20 and 44 of the mobile and stationary forms, respectively. Next, the surfaces that will contact wet cement are coated with a suitable bond breaker. Both soap or oil are among satisfactory materials. Carriage 12 is then advanced along tracks 28, 29 and 30 so that the forward extending portions of rails 24,23 and 22 will extend into tunnels 58, 57 and 56. The rails are locked into place by inserting latches 60, 63 and 61 on framework 44 into respective of slots 32, 33 and 34 on rails 22, 23 and 24. The latches retain the lower portion of the mobile form 10 securely against curb 54 and prevent the two form walls from being forced apart by the pressure of the wet concrete. The top surface of curb 54 will ultimately form the lower horizontal surface of the mold.

End gates 68 and 70 are next positioned so that bars 74 can be inserted through cleats 38, 62 and 72. The bars hold the end gates in position against the pressure of the wet concrete. The end gates form the side surfaces of the mold and keep the concrete from spilling out between the form walls. Because the mold liners are flexible, the mold liners resiliently engage and deform around the edges of the end gates. Thus a water tight, concrete proof barrier is formed. Next, turnbuckles 36 are tightened to engage hooks 64 on the stationary form. The hooks and turnbuckles hold the upper portion of mold together against the pressure of the wet concrete.

Figure 5:
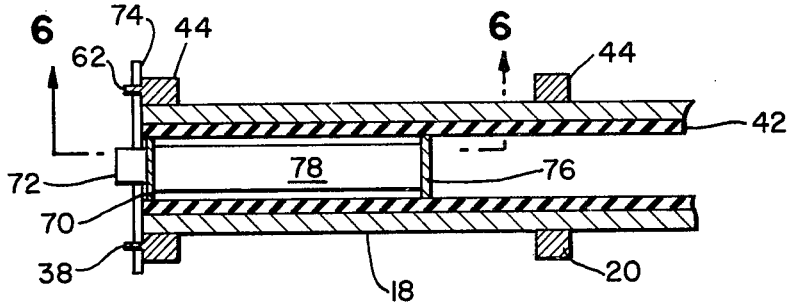
FIG. 5 is a plan view of the top of the mold partially in section taken along line 5—5 of FIG. 4.

When a concrete wall slab is desired that has a smaller length than the distance between the two end gates 68 and 70, slip gate 76 is used. The slip gate is positioned between the form walls at the desired length from one of the end gates. Slip gate 76 rests upon the curb 54 and is braced horizontally from the nearby end gate using support 78. Slip gate 76 provides one of the side surfaces of the mold and keeps the concrete from spilling out between the form walls. The mold liners also resiliently engage and deform around the edges of the slip gate. Referring to FIG. 5, the cavity between end gate 70 and slip gate 76 where support 78 is located is retained free of concrete. The concrete is only poured into the cavity formed between end gate 68 and slip gate 76 shown in FIG. 4.

If internal steel reinforcing bars (not shown) are desired for the concrete slab, a cage of reinforcing bars can be fabricated beforehand. After the forms are locked together, the cage (not shown) can be inserted into the cavity between end gate 68 and either end gate 70 or slip gate 76. The cage can be maintained in position between the form walls by small plastic spacers that are customarily used for horizontally poured wall slabs.

After the form walls have been locked together with the gates in place and the surfaces coated with a bond breaker, the mold is ready to receive the concrete. A conventional concrete pump (not shown) is connected to the lower, vertical end of pouring pipe 48. The end of the flexible section 51 of the pouring pipe is directed into the cavity of mold A. The wet concrete is forced by the concrete pump into the lower end of the pouring pipe 48, out of flexible section 51 and into the cavity formed between the forms and end gate 68 and either end gate 70 or slip gate 76. As the concrete is being poured into mold A, external vibrators 66 on framework 44 are energized to vibrate the whole mold. The vibrators insure that the wet concrete is firmly packed into place and no bubbles are created within the concrete.

After the concrete has hardened sufficiently to permit transportation of the slab, the forms are unlocked. The time interval is usually about four hours. The turnbuckles 36 are loosened and moved out of the way. The bars 74 are removed from the various cleats. Mobile form 10 is unlatched and rolled away from the stationary form 40 on the tracks 28, 29 and 30. An overhead crane (not shown) can be employed to remove the newly cast wall slab from the stationary form and the casting procedure can begin again.

Although only one embodiment of the present invention has been shown and described, it is obvious that other adaptations and modifications to this invention can be made without departing from the true spirit and scope of this invention.

What is claimed is:

1. An adjustable, reusable mold for forming concrete slabs comprising: a first concrete impervious form member; a concrete impervious base member provided with a plurality of slots and having an upper surface; means for fixedly supporting said first form member in a generally upright position on the upper surface of said base member, said fixedly supporting means including first engagement means: a second concrete impervious form member; means for supporting said second member in a generally upright position and for mounting said second member for movement toward and away from said first fixed member along a path generally parallel to said upper surface of said base member, said path comprising a plurality of rails extending into the respective slots in said base member and said supporting and mounting means comprises a wheeled carriage adapted to roll on said rails, said carriage including a plurality of second engagement means adapted to be extended through said slots and interlock with said first engagement means; means for releasably coupling said second member at a pre-determined distance from said first member on said base member; a pair of concrete impervious side members movable into closing relationship to the side opening defined by said first and second members; means for retaining said pair of side members in fluid-tight engagement with said first and second upright members and said base member; and resilient liners secured to and overlying said first and second form members to provide a textural pattern to said concrete slab.

2. A mold in accordance with claim 1 wherein said resilient liners define confronting textured surfaces to provide a corresponding textural pattern to said concrete slab.

3. A mold in accordance with claim 2 wherein said resilient textured surfaces are formed of steel reinforced rubber.

4. A mold in accordance with claim 1 wherein the supporting and mounting means for said second member is further characterized by vibration means secured thereon for vibrating said mold.

5. A mold in accordance with claim 1 and further characterized by means for introducing flowable concrete therein.

* * * * *